US006491198B1

(12) United States Patent
Frank

(10) Patent No.: US 6,491,198 B1
(45) Date of Patent: Dec. 10, 2002

(54) CUTTING BLADE FOR CUTTING SHEET WRAPPING MATERIALS

(75) Inventor: Armin C. Frank, Wyndmoor, PA (US)

(73) Assignee: Metal Edge International, Inc., North Wales, PA (US)

( * ) Notice: Subject to any disclaimer, the term of this patent is extended or adjusted under 35 U.S.C. 154(b) by 0 days.

(21) Appl. No.: 09/439,006

(22) Filed: Nov. 12, 1999

(51) Int. Cl.[7] ..... B26F 3/02
(52) U.S. Cl. ..... 225/39; 225/91
(58) Field of Search ..... 225/90, 91, 39, 225/43, 48, 56, 65, 66, 77, 88, 89, 33; 83/856, 857, 858

(56) References Cited

U.S. PATENT DOCUMENTS

| | | | | |
|---|---|---|---|---|
| 2,771,186 A | | 11/1956 | Burbank | |
| 3,567,087 A | | 3/1971 | Schramm | |
| 3,743,151 A | | 7/1973 | Malcolm | |
| 4,669,191 A | * | 6/1987 | Schramm | 30/358 |
| 4,779,504 A | | 10/1988 | Murphy et al. | |
| 5,772,094 A | * | 6/1998 | Kaiser et al. | 225/91 |
| 5,947,360 A | | 9/1999 | Frank | |
| 5,984,158 A | * | 11/1999 | Frank | 225/91 |

FOREIGN PATENT DOCUMENTS

| | | |
|---|---|---|
| WO | WO 97/19792 | 6/1997 |

* cited by examiner

*Primary Examiner*—Clark F. Dexter
(74) *Attorney, Agent, or Firm*—Dann, Dorfman, Herrell and Skillman; Stephen H. Eland

(57) ABSTRACT

A cutting assembly for plastic film or other sheet wrapping material dispensers. The cutting assembly comprises a member having a length corresponding to the length of the dispenser box, and a U-shaped cross-section adapted to slip over the free edge of the front panel of the dispenser box. The member has a base web with one leg on the inside of the box and a second leg exposed on the outside of the box. The legs meet the web in curved shoulders, diverge downwardly and outwardly, and have extending flaps at their lower ends which are curved back internally of the U-shaped member to provide retainer edges which project angularly upward and inward of the U-shaped member to resist upward displacement of the member from the panel. The proportions of the inwardly curved flaps and the distance between them are such that there is no possibility of the leg or legs of one cutting blade interlocking with the leg or legs of another cutting blade. The open distance between the inwardly curved flaps is somewhat less than the thickness of the panel, and is substantially less than the width of the web, so that the web of one member cannot become interlocked between the legs of other members. The base web of the blade has a flat medial portion, extending between the legs and supporting the teeth.

29 Claims, 3 Drawing Sheets

FIG. 4
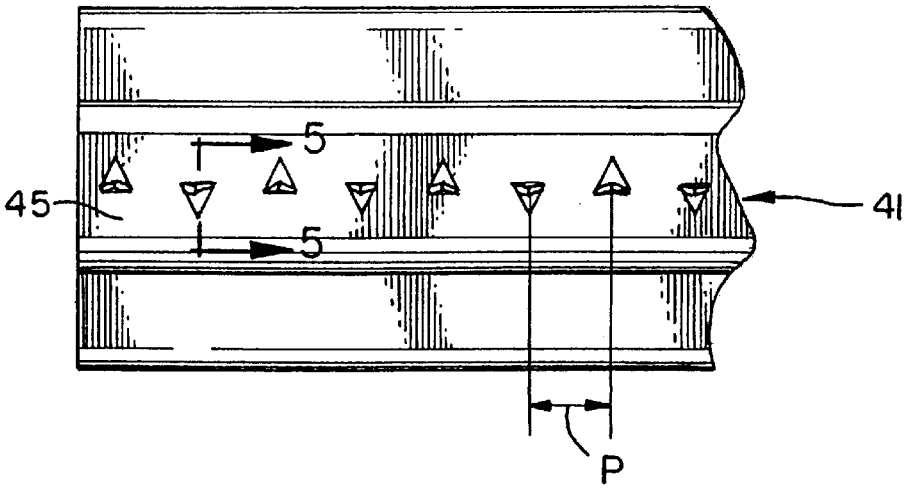
FIG. 5
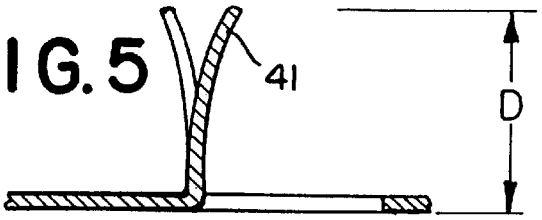
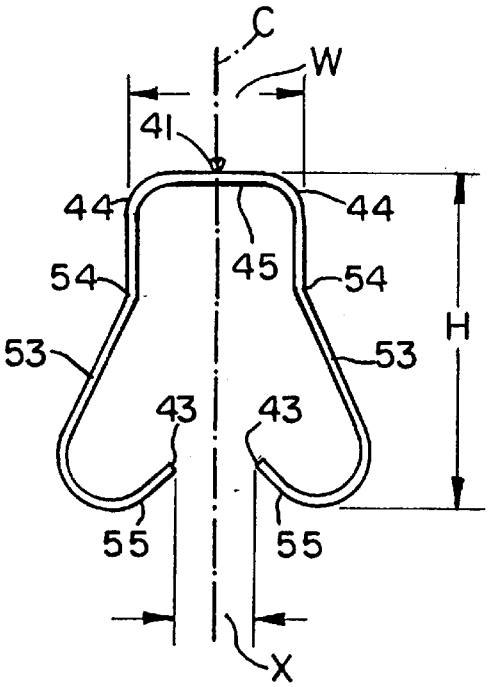
FIG. 6

CUTTING BLADE FOR CUTTING SHEET WRAPPING MATERIALS

RELATED APPLICATIONS

The present application is a further development of the cutting blades described in, and illustrated in FIG. 10 of, my PCT application No. PCT/US96/18923 (WO No. 97/19792) and my U.S. Pat. No. 5,947,360.

FIELD OF THE INVENTION

The present invention relates to cutting blades for cutting sheet wrapping materials. More specifically, the present invention relates to cutting blades used to sever plastic film or other sheet wrapping material that is dispensed from a roll package.

BACKGROUND OF THE INVENTION

Plastic film or other sheet wrapping material is widely used throughout the food industry to wrap or cover various food products. The plastic film or other sheet wrapping material is typically dispensed from a roll contained in a box. Whenever a piece of plastic film or other sheet wrapping material is required, the length of the plastic film or other sheet wrapping material is withdrawn from the box and cut to length by a cutting blade that is attached to the front panel of the box.

The cutting blade commonly used for many years has been a thin metallic saw-toothed blade having cutting points extending along the exposed edge of the blade. Although the points of the cutting blade can nick or cut the user, the real risk to the user results from the cutting blade being made from a thin strip of metal. Just as a piece of paper can cause a cut, the edge of a thin strip of metal, with or without saw-toothed points, can cut. Any exposed edge of the metal strip presents a hazard.

The cutting blades illustrated in my earlier patents (identified above) reduced the risk of injury from the teeth and/or paper cuts from the free edges of the cutter strip.

Cutting blades in the shape illustrated in FIG. 10 of my U.S. Pat. No. 5,947,360 are mass produced as individual pieces, bulk packed and shipped to the manufacturer of plastic film packaged products. This latter manufacturer must remove an individual blade from the bulk shipping container and assemble it to, or loosely deposit it in, the box holding the film. In the shipping container, the prior blades tend to nest or become interlocked with each other and must be manually separated prior to putting them in or on the box.

SUMMARY OF THE INVENTION

In the present invention, a cutting blade for cutting plastic film or other sheet wrapping material is provided which not only reduces the risk of inadvertent cuts to the users or other handlers of the blade but also prevents nesting or interlocking of the blades when they are packed in bulk for shipment to the manufacturer.

The cutting blade may be engaged on the box during completion of the packaging operation by the manufacturer of the wrapping material, or may be deposited in the box by the manufacturer, and thereafter be engaged on the box by the user. The cutting blade allows a user to withdraw a length of sheet wrapping material, such as plastic film material from the box, and cut the sheet wrapping material to length without serious risk of injury to the user. The cutting blade has two parallel longitudinally elongated shoulders connected by a web having a central portion in the form of a substantially flat surface. The longitudinally-elongated shoulders comprise arcuate shoulders extending along the opposite sides of the central portion, and a row of teeth project from the flat surface midway between the sides, so that the row of teeth is parallel to the shoulders and projects upwardly between the shoulders.

The teeth are limited in height and in the preferred embodiment are positioned with roots substantially in the plane of the flat surface, and tips projecting above the plane by a small fraction of the width of the web between its elongated shoulders. The limited projection of the teeth above the plane of the web reduces the ability of the tips to inadvertently cut the user.

BRIEF DESCRIPTION OF THE DRAWINGS

All of the objectives of the present invention are more fully set forth hereinafter with reference to the accompanying drawings, wherein:

FIG. 4 is a plan view of the cutting blade shown in FIG. 3;

FIG. 5 is an enlarged fragmentary sectional view taken on the line 5—5 of FIG. 4; and FIG. 6 is an end view of the cutting blade shown in FIG. 3 with the thickness of the blade material exaggerated.

DETAILED DESCRIPTION OF THE PREFERRED EMBODIMENT

Figure 1:
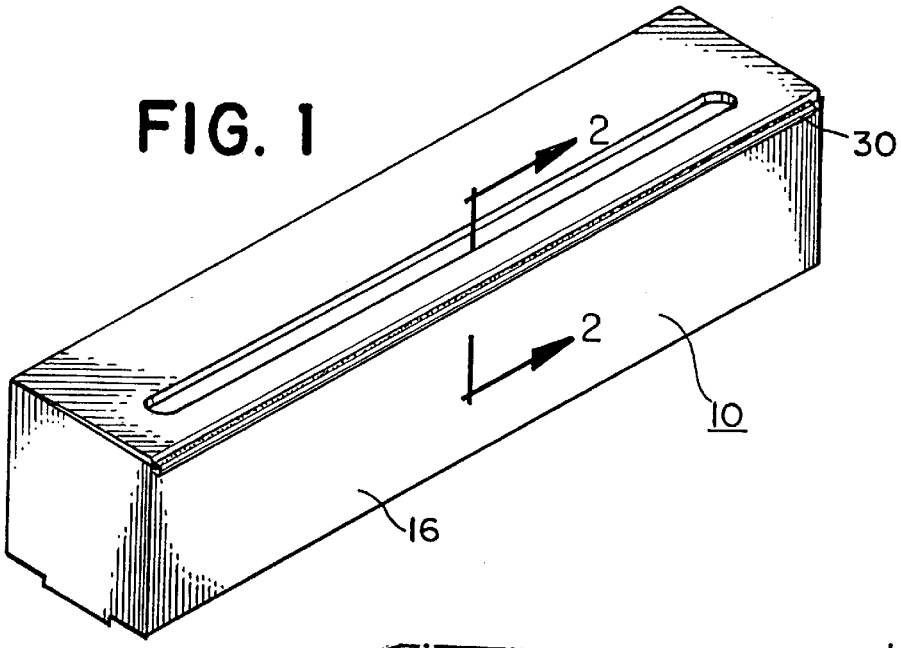
FIG. 1 is a fragmentary perspective view of a dispenser box having a cutting blade incorporating the present invention.
Figure 2:
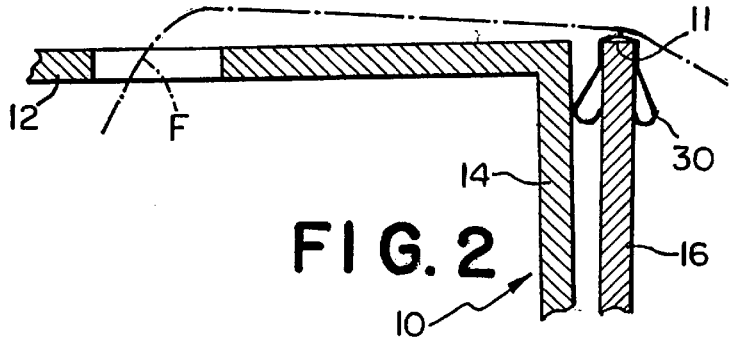
FIG. 2 is a fragmentary sectional view taken on the line 2—2 in FIG. 1 showing in broken lines the wrapping material dispensed from the box.
Figure 3:
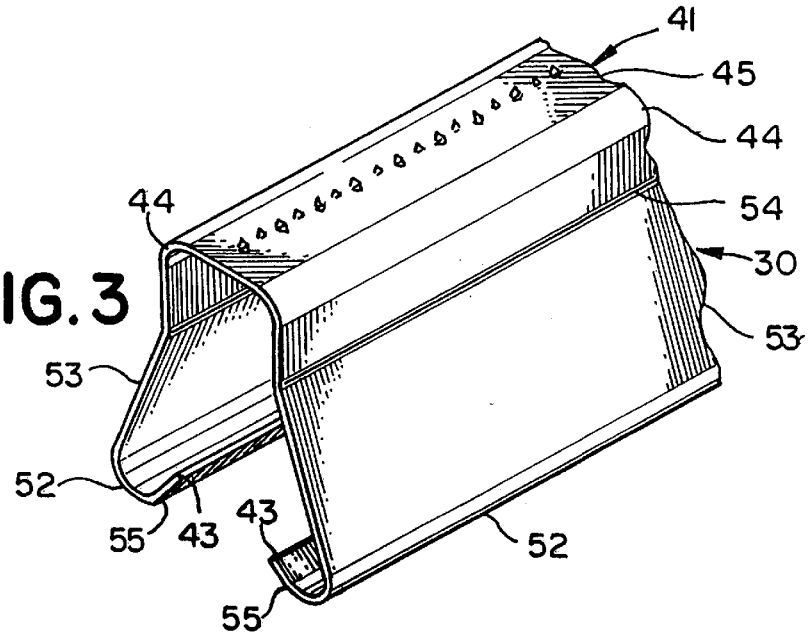
FIG. 3 is a fragmentary perspective view of the cutting blade removed from the box with the thickness of the blade material exaggerated.
Figure 7A:
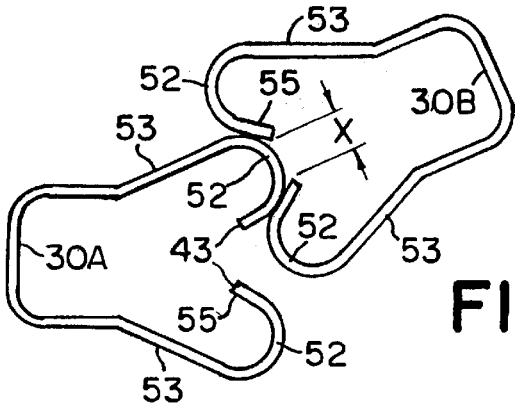
FIGS. 7A to 7D are end views of two cutting blades illustrating the antinesting properties of the blades.
Figure 7B:
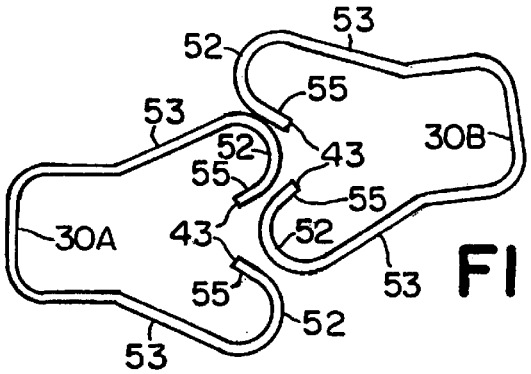
Figure 7C:
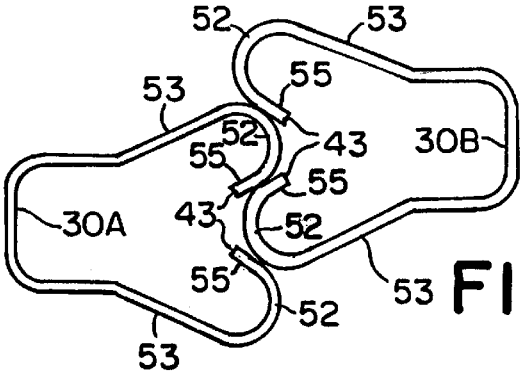
Figure 7D:
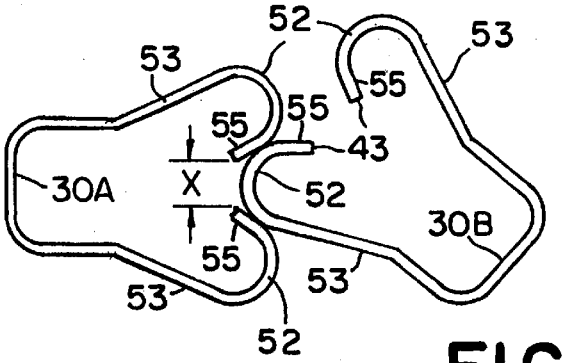

Referring now to the drawings in general and FIGS. 1–3 specifically, there is shown a cutting blade 30 used for cutting sheet wrapping materials such as plastic film F or other sheet wrapping material. In FIG. 1, the cutting blade 30 is shown in connection with a dispensing box 10. A roll (not shown) of plastic film F or other sheet wrapping material is contained within the box 10. In the package shown in FIGS. 1 and 2, the cutting blade 30 is engaged on the free edge 11 of the front panel 16 of the box 10.

Some manufacturers provide a separate panel which is fitted between the front panel and the lid and has an edge projecting above the front panel. In such case, the blade is engaged on the projecting edge. The box has a lid 12 with a flap 14 which is designed to slip behind the panel 16. In operation, the user draws a length of the plastic film or other sheet wrapping material from the roll in the dispenser box 10, as shown at F in FIG. 2, and cuts the material to length by pulling the material angularly down and outward over the cutting blade 30. To ensure that the entire width of the plastic film or other sheet wrapping material is cut rather than torn, it is desirable for the cutting blade 30 to be at least as long as the width of the roll of plastic film or other sheet wrapping material in the dispenser box, and that the cutting teeth extend throughout the length of the blade 30.

The cutting blade 30 may be made from a continuous thin band.

A line of teeth 41 is produced along the centerline of the band. The band is then bent into a U-shape as shown in FIGS. 3 and 6, producing a central web 45 at the base of the U and legs 53 depending downwardly in the same direction from the web 45 to form the legs of the U. At the free extremity of each leg 53, an end flap 55 is reversely curved inwardly into the interior of the U-shaped formation, the flap 55 terminating in the gripper edge 43. The flaps 55 provide a good grip on the panel 16 when the cutter blade is slipped over the free edge 11 of the panel.

As shown in FIGS. 3 and 6, the medial portion of the web 45 is flat and extends between shoulders 44 which define the width W of the base web. The shoulders are quarter-cylinder and have a radius sufficient to provide clearance so that the film may contact the teeth when pulled downward over the cutting blade. The flat medial portion of the web should be wide enough to provide support in the event that the user inadvertently comes in contact with the teeth. In the present instance, the flat medial portion is approximately 40% of the width W and the radius of curvature of the shoulders is approximately 30% of the width W. Each of the legs 53 extends from its associated shoulder 44 past an obtuse bend line 54 to a reverse curve 52 which enables the flap 55 to form an acute angle, for example 45° with the center plane C of the cutter blade. The curves 52 of the two legs are bent toward each other, and in the illustrated embodiment have approximately the same radius of curvature as the shoulders and each other. Above the bend line 54, the upper portion of the legs are parallel to one another and to the center plane C, so as to form with the base web a generally rectangular pocket to receive the upper edge 11 of the panel 16. Below the bend lines 54 the legs diverge downwardly and outwardly. The terminal edges 43 of the legs 53 are spaced apart within the center of the U-shaped cutting blade by a spacing X which is substantially smaller than the width W of the base web of the cutting blade. Therefore, cutting blades will not nest as the top of one cutting blade cannot enter the space between the edges 43 of the legs of another cutting blade. In addition, as shown in FIGS. 7A to 7D, the curves 52, the end flaps 55 and the spacing X are so proportioned that there is no possibility of the leg or legs of one cutting blade entering the U-shaped cavity of another cutting blade and thereby interlocking with the leg or legs of another cutting blade in any position or angle.

Referring now to FIGS. 4 and 5, the cutting blade 30 comprises a row of cutting teeth 41 projecting perpendicularly from a flat surface 45. If the cutting teeth are spaced sufficiently close to one another and project only modestly above the flat surface 45, the teeth will cut plastic film but not human skin. The result is similar to the bed of nails employed by fakirs of India who are able to lie on a bed of closely spaced nails without damage to their skin. While the cutting teeth 41 are closely spaced, they are located in a single line and thus require another feature to prevent damage to human skin while retaining the ability to cut plastic film. When the teeth are limited in height D above the flat surface 45, preferably 0.015" to 0.035", film can be easily cut and the potential to cut skin is minimized. The pitch P of the teeth is between 12 and 22 teeth per inch. By limiting the height D, skin which is in contact with the teeth will tend to bend around the teeth and come to rest on, and be supported by, the flat surface 45. Only excessive pressure combined with motion across the teeth can cause a cut or abrasion which in any case is limited to the depth D of the tooth. Conversely, because plastic film is more elastic and frangible than human skin, it is easily pulled down over the points of the teeth and thereby cut before it has come in contact with flat surface 45. In the present instance, the cutting teeth 41 project approximately 0.020" from the flat surface 45 while the pitch P of the teeth is approximately 0.055" i.e. 18 teeth per inch.

The cutter blade of the present invention is designed to be attached to the box either by the end users or by the manufacturer of the packaged plastic film or other sheet wrapping material product. Configured as shown in FIG. 2, the user can slip the cuting blade 30 over a front panel 16 which is typically a piece of cardboard or corrugated board having a free edge 11. Typically, the user will simply push, the cutting blade 30 over the front panel of a dispenser box 10 until the underside of the web 45 seats against the free edge 11. The inwardly-curved flaps 55 of the cutting blade 30 tend to grip the cardboard 16 so that the cutting blade 30 resists being removed from the cardboard. In addition, by curving back the lower edges of both legs 53, the exposed edges of the legs are inside the U-shaped channel, thus eliminating the risk that the lower edges of the legs can inadvertently cut the user.

As shown in FIGS. 3 and 4, the teeth 41 are generally triangular in shape and have their bases disposed in the centerline of the flat portion where it intersects the center plane C of the flat portion between the shoulders 44. The bases of the teeth are aligned and are punched out alternately on opposite sides of the centerline of the flat portion. As shown in FIG. 5, when punched out of a flat surface, the punching operation allows the teeth to project away from the center plane as shown. Thus, the teeth that are punched out of the flat portion on one side of the centerline are canted toward that side of the centerline and the teeth which are punched out of the other side of the centerline are canted toward the other side of the centerline. Thus, this punching operation enables the teeth to present tips facing away from both sides of the center plane. Because of this orientation of the teeth as shown in FIG. 5, the cutter blade is symmetrical about its center plane C and the blade may be positioned on the free edge 11 of the panel 16 in either direction. Due to the symmetry of the cutter blade, the teeth will provide a cutting action for the film as the film is drawn down over the teeth in either direction. With this construction, the user may mount the blade on the panel without detailed instruction regarding the proper orientation of the blade.

With the illustrated configuration of the cutter blade in FIG. 2, the divergent leg which is positioned on the inner surface of the panel 16 below its edge 11 may serve to retain the hinged lid 12 of the box 10 in the closed position. To obtain this effect, the user simply presses the lid into the box a sufficient distance to allow the free front edge of the lid to pass below the cutting blade 30, so that the curved portion 52 of the divergent leg 53 which is on the inside of the panel may retain the lid closed.

While particular embodiments of the invention have been herein illustrated and described, it is not intended to limit the invention to such disclosures, but changes and modifications may be made therein and thereto within the scope of the following claims.

What is claimed is:

1. A cutting blade for cutting sheet wrapping materials comprising:

a web;

two spaced-apart parallel longitudinally-elongated shoulders on opposite sides of said web;

two longitudinally-elongated side legs connected to said web along said sides by said shoulders and extending below said web surface to provide an inverted U-shape, said legs diverging outwardly relative to one another and downwardly from said web; and a row of teeth spaced between and parallel to said shoulders, projecting above said web intermediate said shoulders in a direction opposite to said legs and generally parallel thereto.

2. A cutting blade according to claim 1 wherein said teeth have a depth between 0.015" and 0.035" and a pitch between 12 and 22 teeth per inch.

3. A cutting blade according to claim 2 wherein said teeth are generally triangular with points projecting upwardly and roots disposed in a plane of said web.

4. A cutting blade according to claim 3 wherein said teeth are in a line along a center plane perpendicular to the plane of said web, alternate teeth in said line projecting upwardly away from one side of the center plane and intermediate teeth in said line projecting upwardly away from the opposite side of the center plane.

5. A cutting blade according to claim 4 wherein said blade is symmetrical about said center plane so that it may be installed without regard to the orientation of said blade.

6. A cutting blade according to claim 1 wherein said side legs are spaced apart by a given width at their junctions with said shoulders, and terminate below said web in a reverse curve forming a flap turned inwardly of said inverted U-shape, each of said flaps having a curve terminating in a free gripper edge, said gripper edges being spaced apart by a distance less than said given width to prevent entry of said spaced-apart shoulder inwardly of said inverted U-shape.

7. The cutting blade of claim 1 comprising a flap connected to the lower side of each of said side legs by a reverse curve, said flaps extending inwardly of said U-shape and terminating in gripper edges directed toward said web within said U-shape, whereby said edges permit ready engagement of said U-shaped blade onto a panel and resist ready disengagement of said U-shaped blade from the panel.

8. The cutting blade of claim 7 wherein said gripper edges of said flaps are spaced apart by a distance less than the width of said web between said shoulders.

9. The dispenser of claim 8 wherein said two longitudinally-elongated side legs have parallel upper portions perpendicular to said web, and lower portions diverging outwardly relative to one another and downwardly from said web, such that each lower portion forms an obtuse angle relative to the corresponding upper portion.

10. The cutting blade of claim 7 wherein each of said legs has a parallel flat upper portion and an intersecting diverging portion wherein the intersection between the upper portion and the lower portion forms an obtuse angle with the diverging portions of the legs diverging relative to one another.

11. The cutting blade of claim 7 wherein said side legs are spaced apart by a given width at their junctions with said shoulders, each of said flaps of said side legs forming a reverse curve turned inwardly of said inverted U-shape and having a curvature with a radius of curvature terminating in one of the gripper edges, said curvature of said legs spacing said gripper edges from each other by a distance less than said given width.

12. The cutting blade of claim 11 having a center plane midway between said parallel upper portions, and wherein the terminal parts of said flaps are at an acute angle to said center plane.

13. A cutting blade according to claim 1 wherein each of said side legs terminate below said web in a reverse curve forming a flap turned inwardly of said inverted U-shape, wherein the flaps are spaced apart from one another forming an opening having a given width, and each flap has a width that is greater than the given width.

14. A dispenser for sheet wrapping materials, comprising:

a box having a front panel with an upwardly facing free edge, and a lid spaced from said front panel to dispense wrapping material between said front panel and said lid, and a cutting blade for cutting the wrapping material, said cutting blade comprising:

a web;

two spaced-apart parallel longitudinally-elongated shoulders on opposite sides of said web;

two longitudinally-elongated side legs connected to said web along said sides by said shoulders and extending below said web to provide an inverted U-shape, said U-shape being positioned over said panel free edge, said legs diverging outwardly relative to one another and downwardly from said web; and a row of teeth spaced from and parallel to said shoulders, projecting above said web intermediate said shoulders in a direction opposite to said legs and generally parallel thereto.

15. The dispenser of claim 14 said legs terminating in reversely-curved flaps at the lower ends of said side legs, each of said flaps being reversely curved upward and having a free edge constituting a gripper edge within said inverted U-shape, said gripper edges engaging opposite surfaces of said panel to anchor the inverted U-shape of said blade over said free edge of the panel.

16. The dispenser of claim 14 wherein each of said side legs terminate below said web in a reverse curve forming a flap turned inwardly of said inverted U-shape, wherein the flaps are spaced apart from one another forming an opening having a given width, and each flap has a width that is greater than the given width.

17. The dispenser of claim 16 wherein the box panel has a thickness that is greater than the given width.

18. A cutting blade for cutting sheet material, comprising:

a plurality of cutting teeth projecting upwardly from a web;

a pair of legs spaced apart from one another, projecting downwardly from the web and diverging from one another; and a reverse curve formed on the end of each leg remote from the web, wherein the reverse curves each have a width, and the reverse curves are spaced apart from one another forming an opening having a width that is less than the width of each reverse curve.

19. The cutting blade of claim 18 wherein the web has a width that is greater than the width of the opening.

20. The cutting blade of claim 18 wherein the reverse curves form gripping portions operable to readily engage a cardboard panel to mount the cutting blade on the panel.

21. The cutting blade of claim 18 wherein the web is substantially flat, and the teeth project upwardly from the web.

22. The cutting blade of claim 18 wherein the legs are integrally formed with the web.

23. A cutting blade for cutting sheet material, comprising:

a thin band formed of a deformable material;

a plurality of teeth projecting upwardly from the band;

a pair of legs spaced apart from one another and projecting downwardly from the band, wherein each leg comprises:

a diverging portion connected with the band and projecting outwardly, so that the diverging portions of the legs diverge relative to one another;

a converging portion intersecting the diverging portion and projecting inwardly, so that the diverging portions of the legs converge relative to one another; and an attachment portion attached to the converging portion, operable to attach the cutting blade to a generally planar substrate.

24. The cutting blade of claim 23 wherein the ends of the attachment portions form gripping edges and a gap is formed between the gripping edges, and each leg has a width that is greater than the gap.

25. The cutting blade of claim 24 wherein the band has a width that is greater than the gap.

26. The cutting blade of claims 23 wherein the legs have terminal ends that are spaced apart from one another to form a gap and each converging portion has a width that is greater than the gap.

27. The cutting blade of claim 23 wherein the band has a width and the distance between the legs at the intersection of the converging and diverging portions is greater than the width of the band.

28. The cutting blade of claim 23 wherein each leg comprises a parallel portion extending between the band and the diverging portion, projecting downwardly from the band, so that the parallel portions of the legs are generally parallel to one another.

29. The cutting blade of claim 28 wherein the band has a substantially planar portion and the parallel portions of the legs are generally perpendicular to the band.

* * * * *

UNITED STATES PATENT AND TRADEMARK OFFICE

CERTIFICATE OF CORRECTION

PATENT NO. : 6,491,198 B1
DATED : February 19, 2003
INVENTOR(S) : Frank

It is certified that error appears in the above-identified patent and that said Letters Patent is hereby corrected as shown below:

Column 4,
Line 67, “surface” should be deleted;

Column 5,
Line 3, “between” should read -- from --;

Signed and Sealed this

Second Day of December, 2003

JAMES E. ROGAN
*Director of the United States Patent and Trademark Office*